US008550859B2

(12) United States Patent
Van Swearingen

(10) Patent No.: US 8,550,859 B2
(45) Date of Patent: Oct. 8, 2013

(54) CLOSE PROXIMITY PANEL MOUNT CONNECTORS

(75) Inventor: Kendrick Van Swearingen, Woodridge, IL (US)

(73) Assignee: Andrew LLC, Hickory, NC (US)

( * ) Notice: Subject to any disclaimer, the term of this patent is extended or adjusted under 35 U.S.C. 154(b) by 132 days.

(21) Appl. No.: 13/277,611

(22) Filed: Oct. 20, 2011

(65) Prior Publication Data

US 2013/0102200 A1 Apr. 25, 2013

(51) Int. Cl.
*H01R 24/00* (2011.01)

(52) U.S. Cl.
USPC ..... 439/660; 439/717

(58) Field of Classification Search
USPC ..... 439/660, 717, 314, 712, 710, 333, 439/594, 649
See application file for complete search history.

(56) References Cited

U.S. PATENT DOCUMENTS

| | | | | |
|---|---|---|---|---|
| 3,372,349 | A | 3/1968 | Concelman | |
| 3,566,334 | A | 2/1971 | Ziegler, Jr | |
| 3,701,083 | A | 10/1972 | Ziegler, Jr. | |
| 3,980,385 | A | 9/1976 | Hirokawa et al. | |
| 4,571,014 | A | 2/1986 | Robin et al. | |
| 4,697,859 | A | 10/1987 | Fisher, Jr. | |
| 4,749,251 | A | 6/1988 | Moulin | |
| 4,846,714 | A | 7/1989 | Welsby et al. | |
| 4,941,836 | A | 7/1990 | Bormuth | |
| 5,190,472 | A | 3/1993 | Voltz et al. | |
| 5,348,491 | A | 9/1994 | Louwagie et al. | |
| 5,516,303 | A | 5/1996 | Yohn et al. | |
| 5,769,652 | A | 6/1998 | Wider | |
| 6,129,563 | A | 10/2000 | Weidner | |
| 6,409,550 | B1 | 6/2002 | Splichal et al. | |
| 6,679,726 | B1 | 1/2004 | Tunn et al. | |
| 6,692,285 | B2 | 2/2004 | Islam | |
| 6,790,080 | B2 | 9/2004 | Cannon | |
| 6,811,432 | B2 | 11/2004 | Cabalka et al. | |
| 6,848,948 | B1 | 2/2005 | Khemakhem et al. | |
| 6,881,100 | B2 * | 4/2005 | Barry et al. | 439/701 |
| 7,074,080 | B1 | 7/2006 | Khemakhem et al. | |
| 7,181,999 | B1 | 2/2007 | Skeels et al. | |
| 7,244,146 | B2 | 7/2007 | Gherandini | |
| 7,479,034 | B2 | 1/2009 | Blakborn et al. | |
| 7,553,177 | B2 | 6/2009 | Antonini et al. | |
| 7,837,502 | B2 | 11/2010 | Van Swearingen et al. | |
| 2004/0014367 | A1 | 1/2004 | Petersen | |
| 2011/0237122 | A1 | 9/2011 | Schwarz | |
| 2012/0129375 | A1 * | 5/2012 | Van Swearingen | 439/314 |
| 2012/0302088 | A1 * | 11/2012 | Van Swearingen et al. | 439/378 |
| 2013/0065420 | A1 * | 3/2013 | Van Swearingen et al. | 439/372 |
| 2013/0065422 | A1 * | 3/2013 | Van Swearingen et al. | 439/378 |

* cited by examiner

*Primary Examiner* — Hae Moon Hyeon
(74) *Attorney, Agent, or Firm* — Babcock IP, PLLC

(57) ABSTRACT

Close proximity panel mount connectors include a first and a second connector body, each provided with a connection interface at an interface end, a mounting flange with a planar surface at a mounting end, a fastener tab of the mounting flange provided with a tab fastener hole at a male side of the connector body and a fastener slot of the mounting flange formed at a female side of the connector body, a slot fastener hole provided through the mounting flange to the fastener tab slot. The fastener tab of the first connector body seats within the fastener slot of the second connector body when the male side of the first connector body is seated adjacent to the female side of the second connector body, coaxially aligning the tab fastener hole of the first connector body and the slot fastener hole of the second connector body.

17 Claims, 9 Drawing Sheets

CLOSE PROXIMITY PANEL MOUNT CONNECTORS

BACKGROUND

1. Field of the Invention

This invention relates to electrical connectors. More particularly, the invention relates to a connector enabling a high density close proximity panel mounting characteristic, without requiring a pre-determined number of connections.

2. Description of Related Art

Coaxial cable connectors are used to terminate coaxial cables, for example, in communication systems requiring a high level of precision and reliability.

Connectors may be mounted on panels and/or equipment enclosures as an environmentally and/or electrically isolated interconnection point for electrical cables transmitting Radio Frequency (RF), control signals and/or electrical power between other panels and/or equipment enclosures or remote equipment such as antennas or the like.

Where the panel and/or electrical enclosure is small and/or requires multiple isolated cable and/or device interconnections, surface space available for panel mount type connectors may be limited, necessitating a high density interconnection solution.

Conventional panel mount connectors, for example for coaxial cables transmitting RF signals, each feature a separate connector body with a base flange typically configured to receive four fasteners for securing the connector to the planar surface of the panel. The space required for seating these fasteners and/or accessing the coupling nut of the attaching connector presents a minimum footprint dimension for each connector.

Preconfigured high density ganged arrangements with multiple connector ports sharing a common outerbody and/or integrated panel mounting arrangement are known. However, these arrangements are typically designed for a fixed number of connection ports, reducing design flexibility if the fixed number of connection ports is not the number required for a specific implementation. Manufacture and inventory of a plurality of separate assemblies, each with a different number of connection ports selected in anticipation of market demand, increases manufacturing and inventory costs. Where a ganged arrangement is applied, but each of the available connection ports is not utilized, additional material expense and/or manufacturing steps may be required. Further, environmental seal and/or RF shielding issues may arise.

Competition in the coaxial cable connector market has focused attention on improving electrical performance, interconnection quality consistency and design flexibility. Further, reduction of overall costs, including materials, training and installation costs, is a significant factor for commercial success.

Therefore, it is an object of the invention to provide a coaxial connector and method of interconnection that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has recognized that panel mount type connector mounting density may be increased, while maintaining design flexibility and connector mounting integrity, when clearance between connector bodies is minimized and fastening points are shared between adjacent connectors.

Figure 1:
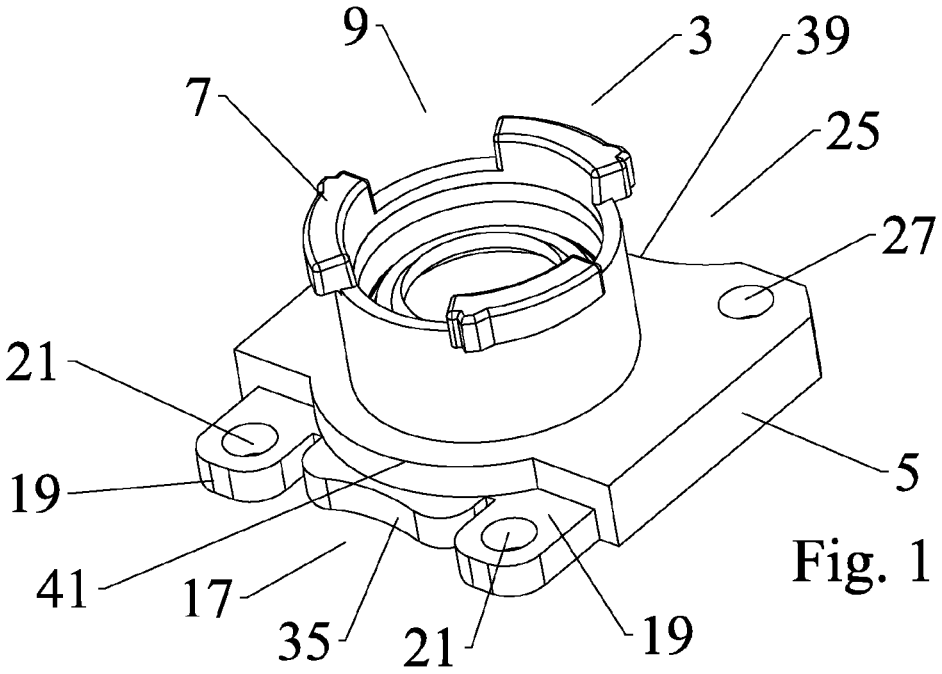
FIG. 1 is a schematic angled isometric top view of a first exemplary embodiment of a connector body.
Figure 2:
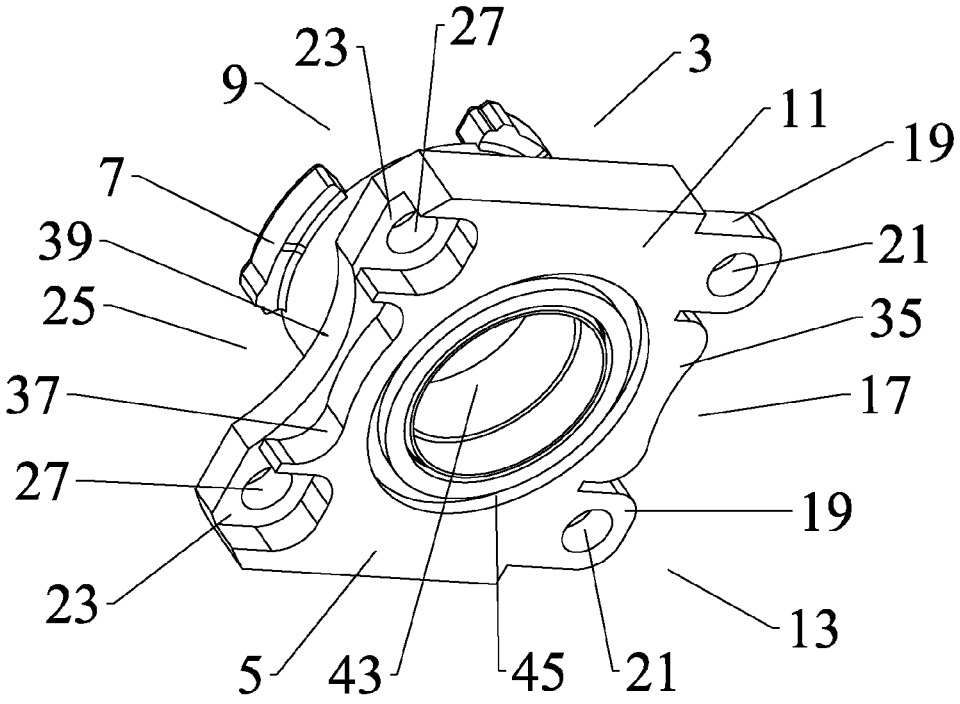
FIG. 2 is a schematic angled isometric bottom view of the connector body of FIG. 1.
Figure 3:
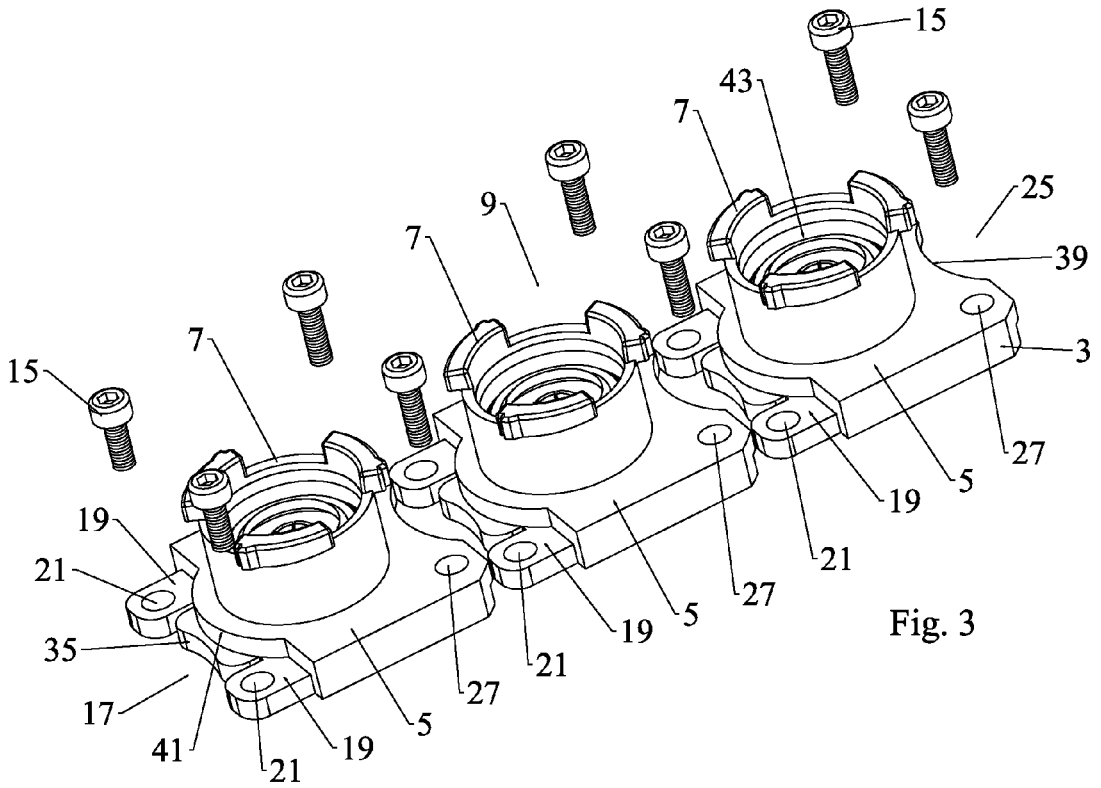
FIG. 3 is a schematic angled isometric exploded top view of a plurality of connector bodies according to FIG. 1.
Figure 4:
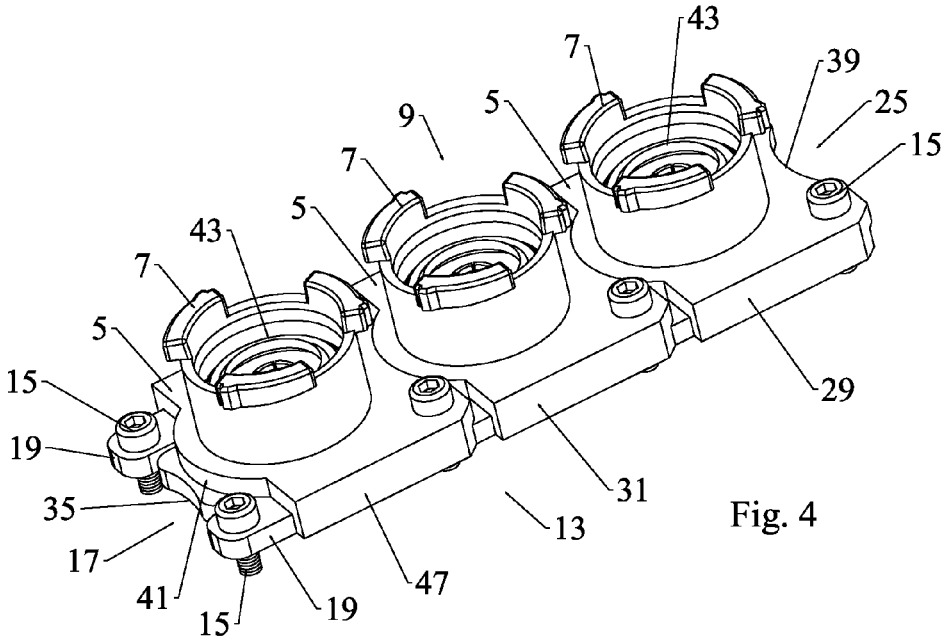
FIG. 4 is a schematic angled isometric view of the connector bodies of FIG. 3, coupled together in in-line close proximity.

As shown best shown in FIGS. 1 and 2 a first embodiment of a panel mount connector body 3 has a mounting flange 5 for mounting the connector body 3 securely upon a desired planar mounting surface (not shown) of a desired panel or other enclosure.

The connector body 3 is provided with a connection interface 7 at an interface end 9 and the mounting flange 5 with a planar surface 11 at a mounting end 13. The mounting flange dimensions may be selected to provide sufficient surface area for fasteners 15 to secure the connector body 3 to the desired mounting surface, for example considering forces which may be applied to the connector body 3 by attached connectors and associated electrical cables and/or material characteristics of the selected mounting surface such as the thickness and/or rigidity of the material of the mounting surface.

A male side 17 of the mounting flange 5 is provided with at least one fastener tab 19 provided with a tab fastener hole 21. A corresponding fastener slot 23 formed in a female side 25 of the mounting flange 5 has a slot fastener hole 27 provided through the mounting flange 5 to the fastener slot 23. The fastener tab 19 and fastener slot 23 are complementary with one another. As shown for example in FIGS. 3-6, the fastener tab 19 of a first connector body 29 seats within the fastener slot 23 of a second connector body 31 when the male side 17 of the first connector body 29 is seated adjacent to the female side 25 of the second connector body 31. This seating results in the coaxial alignment of the tab fastener hole 21 of the first connector body 29 and the slot fastener hole 27 of the second connector body 31, whereby a fastener 15 inserted through the slot fastener hole 27 also passes through the tab fastener hole 21, securely binding the adjacent first and second connector bodies 29, 31 both to one another and to the mounting surface.

Where each of the connector bodies 3 has two fastener tabs 19 and two fastener slots 23, for example when each of the tab fastener holes 21 and each of the slot fastener holes 27 is provided proximate a corner of the mounting flange 5, a perimeter line between each of the tab fastener holes 21 and each of the slot fastener holes 27 may form a rectangle in the plane of the planar surface 11, providing a balanced anchoring of the connector body 3 to the mounting surface.

Further keying between connector bodies 3 may be provided by including a flange tab 35 projecting from the male side 17, between the two fastener tabs 19 and a corresponding flange slot 37 on the female side 25, between the two fastener slots 23. If present, the flange tab 35 similarly seats within the flange slot 37 when the male side 17 of the first connector body 29 is seated adjacent to the female side 25 of the second connector body 31.

To prevent the fastener slot from introducing a weak point when a fastener 15 is tightened between the mounting flange 5 and the mounting surface, without a fastener tab 19 present, such as for the first connector body 29 in a row, the fastener slot 23 may be configured to be cut inwards from the female side 25 such that the planar surface 11 surrounds the fastener slot 23 on at least three sides.

To minimize side to side spacing between adjacent connector bodies 3, without reducing the dimensions of the four corners of the mounting flange 5, the female side 25 of the mounting flange 5 may be provided with a female surface 39, such as a convex surface and the male side 17 of the mounting flange 5 provided with a corresponding male surface 41, such as a concave surface, wherein when adjacent the male surface 41 protrudes to seat within/against the female surface 39, for example where the concave and convex surfaces have the same radius of curvature. Thereby, the male and female surfaces 39, 41 may mate with one another to provide additional keying therebetween when fasteners 15 are shared in common between adjacent connector bodies 3, without interfering with the dimensions of the connection interface 7 or otherwise extending the mounting flange 5 dimensions.

A bore 43 through the connector body 3 between the interface end 9 and the mounting end 13 passes conductors and/or waveguide structure through connector body 3 to the mounting surface. The connection between the connector body 3 and the mounting surface may be environmentally sealed by a seal (not shown) seated within a seal groove 45 formed in the planar surface 11 surrounding the bore 43, the seal groove 45 open to the mounting end 13.

To mount a plurality of the connector bodies 3 in a close proximity row, the first connector body 29 may be retained by applying fasteners 15, such as screws, bolts, rivets, pins or the like, through the slot fastener holes 27 to seat the female side 25 of the first connector body 3 against the mounting surface. The second connector body 31 is seated adjacent to the first connector body 29, female side 25 of the second connector body 31 against the male side 17 of the first connector body 29, seating the fastener slot 23 of the second connector body 31 over the fastener tab 19 of the first connector body 29, coaxially aligning the tab fastener hole 21 of the first connector body 29 and the slot fastener hole 27 of the second connector body 31 so that fasteners 15 may be applied therethrough, seating the male side 17 of the first connector body 29 and the female side 25 of the second connector body 31 against the mounting surface.

One skilled in the art will appreciate that any desired number of additional connector bodies 47 may be similarly successively applied either at the time of initial installation and/or as an addition to an existing installation as expansion and/or configuration changes occur.

The connection interface 7 applied may be any desired standard or proprietary connection interface. In the first exemplary embodiment of FIGS. 1-6, a proprietary tab lock type interface with the benefit of requiring minimal rotation of the coupling nut 49 to obtain secure interconnection is demonstrated. Alternatively, FIGS. 7-12 demonstrate a second exemplary embodiment where the connection interface 7 is a standard 7/16 DIN female. Although the exemplary embodiments demonstrate an RF coaxial cable connection/termination, one skilled in the art will appreciate that the connector body 3 may be utilized with any type of electrical and/or optical connection, such as multiple individual signal conductors and/or high current electrical cables. Further, the type of electrical cable and/or connection interface 7 that is selected may be different between adjacent located connector bodies 3.

Figure 5:
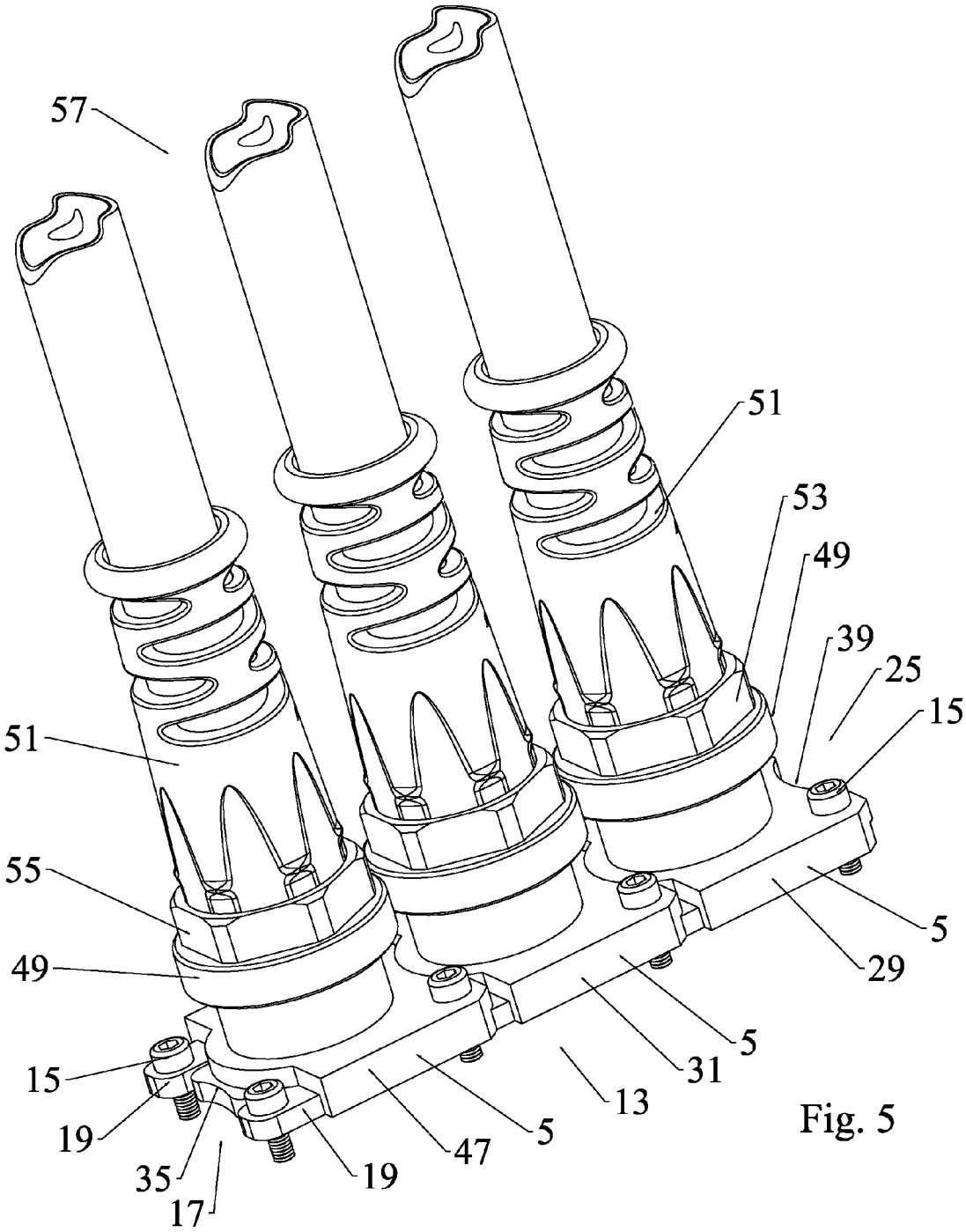
FIG. 5 is a schematic angled isometric view of FIG. 4, demonstrated with attaching connectors attached.
Figure 6:
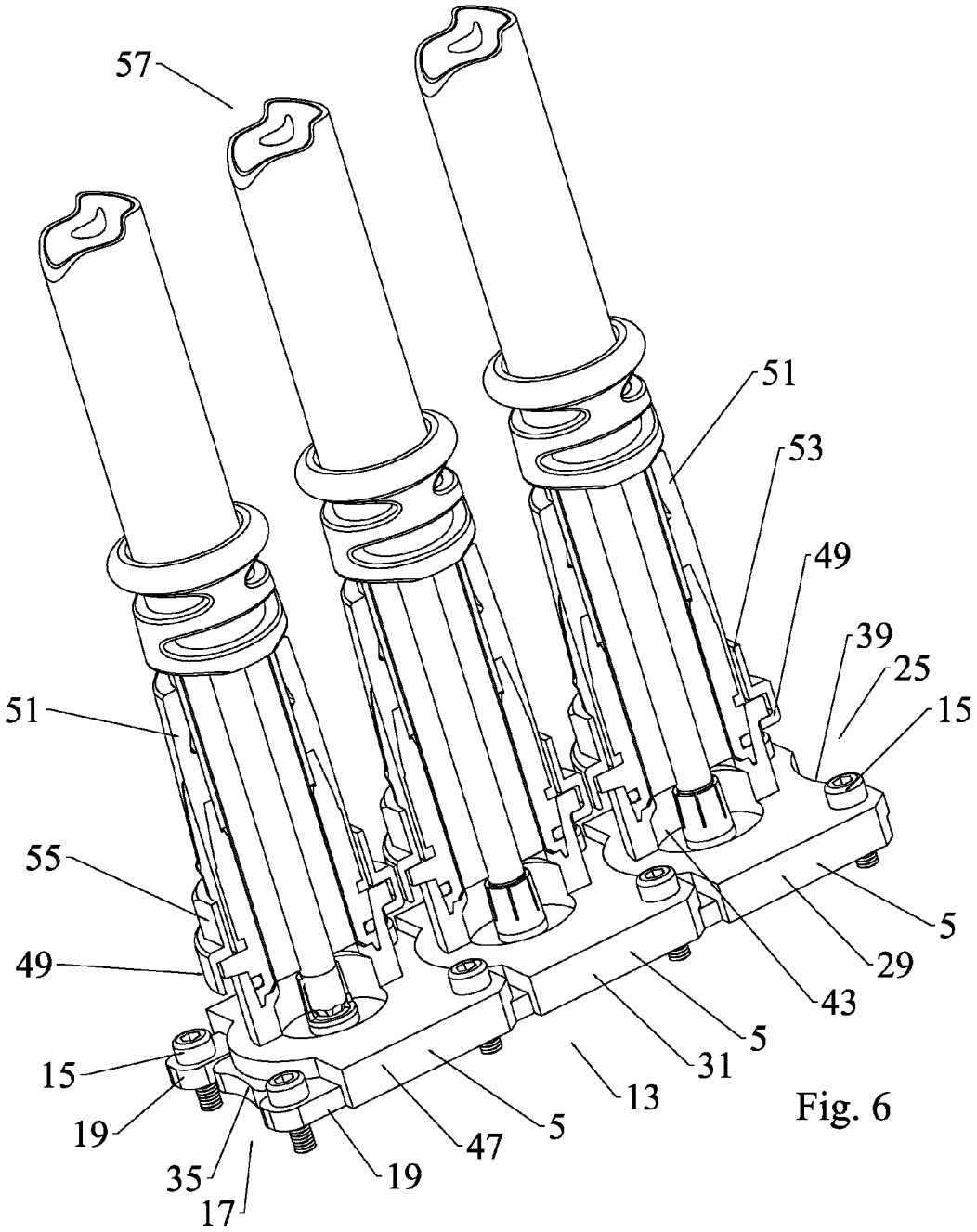
FIG. 6 is a partial cut-away view of FIG. 5.
Figure 7:
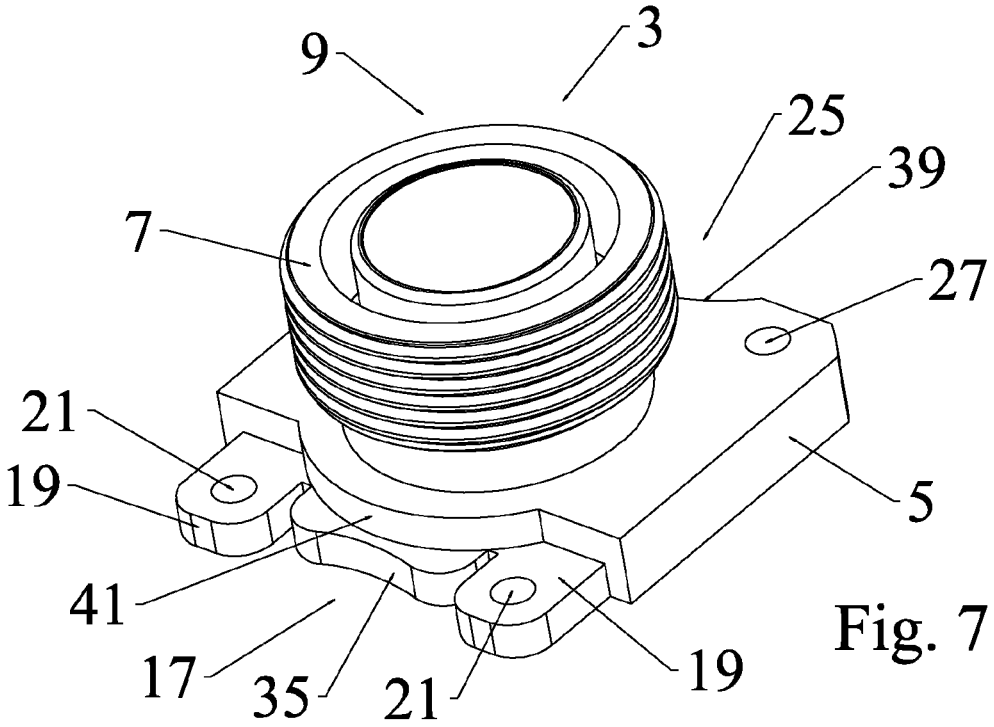
FIG. 7 is a schematic angled isometric top view of a second exemplary embodiment of a connector body.
Figure 8:
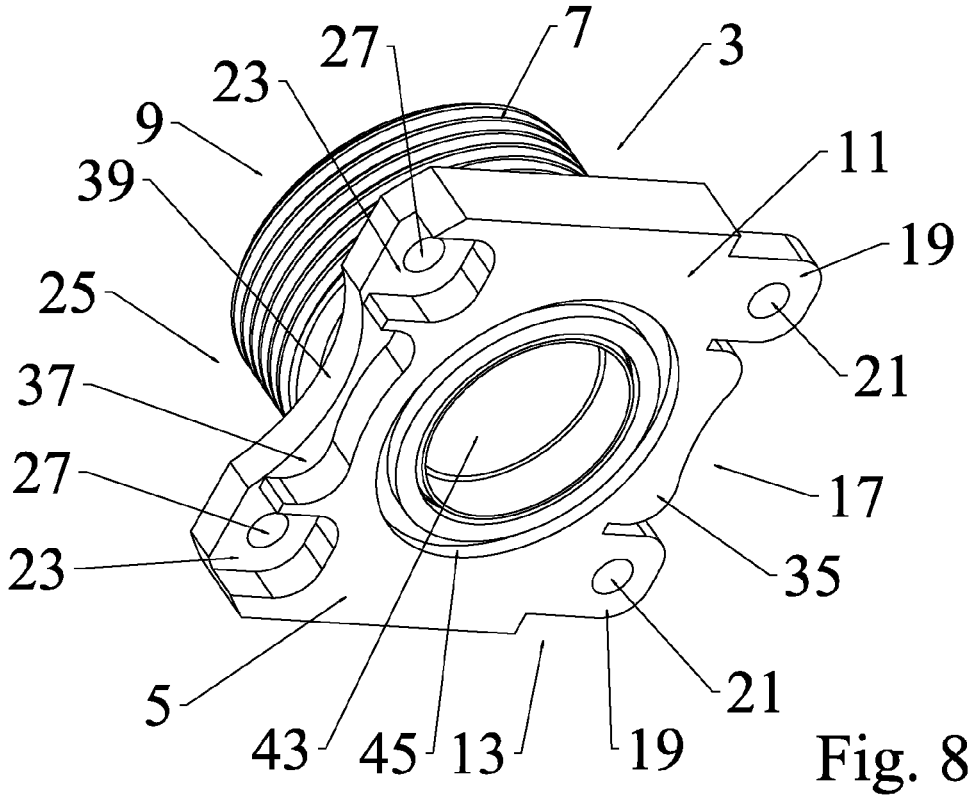
FIG. 8 is a schematic angled isometric bottom view of the connector body of FIG. 7.
Figure 9:
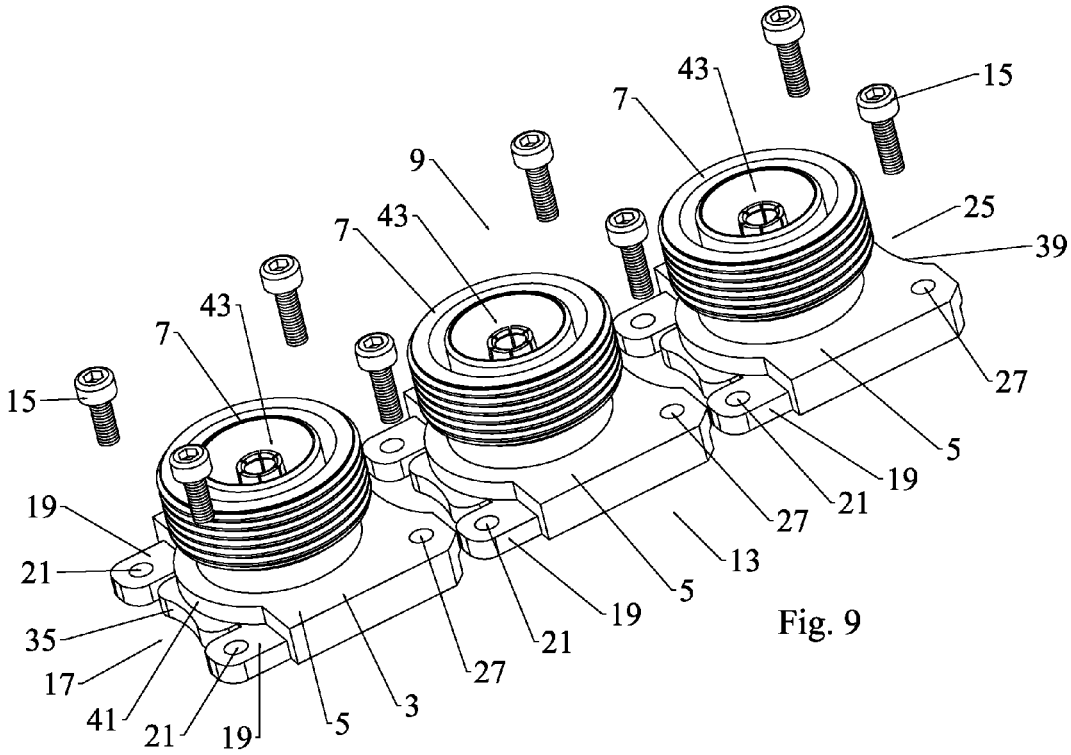
FIG. 9 is a schematic angled isometric exploded top view of a plurality of connector bodies according to FIG. 7.
Figure 10:
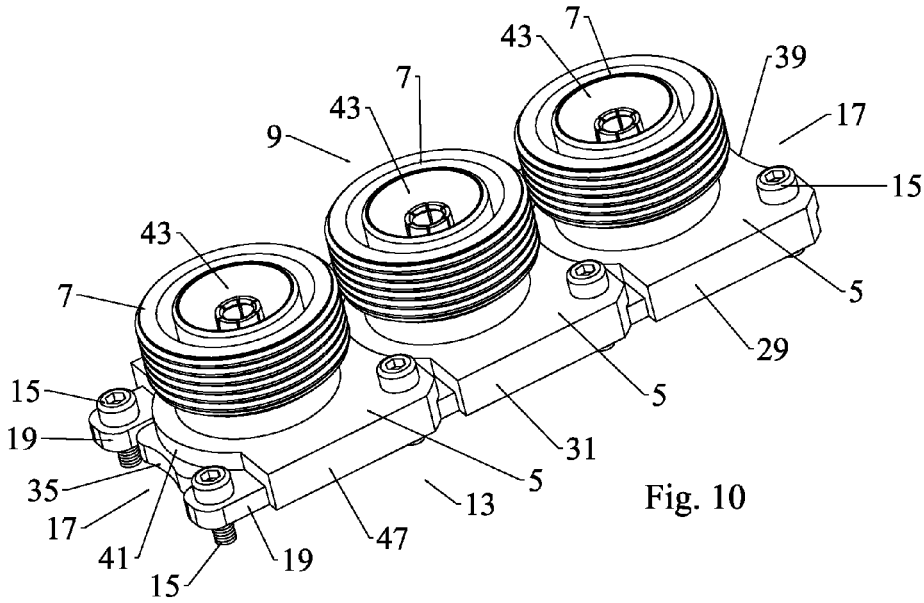
FIG. 10 is a schematic angled isometric view of the connector bodies of FIG. 9, coupled together in in-line close proximity.
Figure 11:
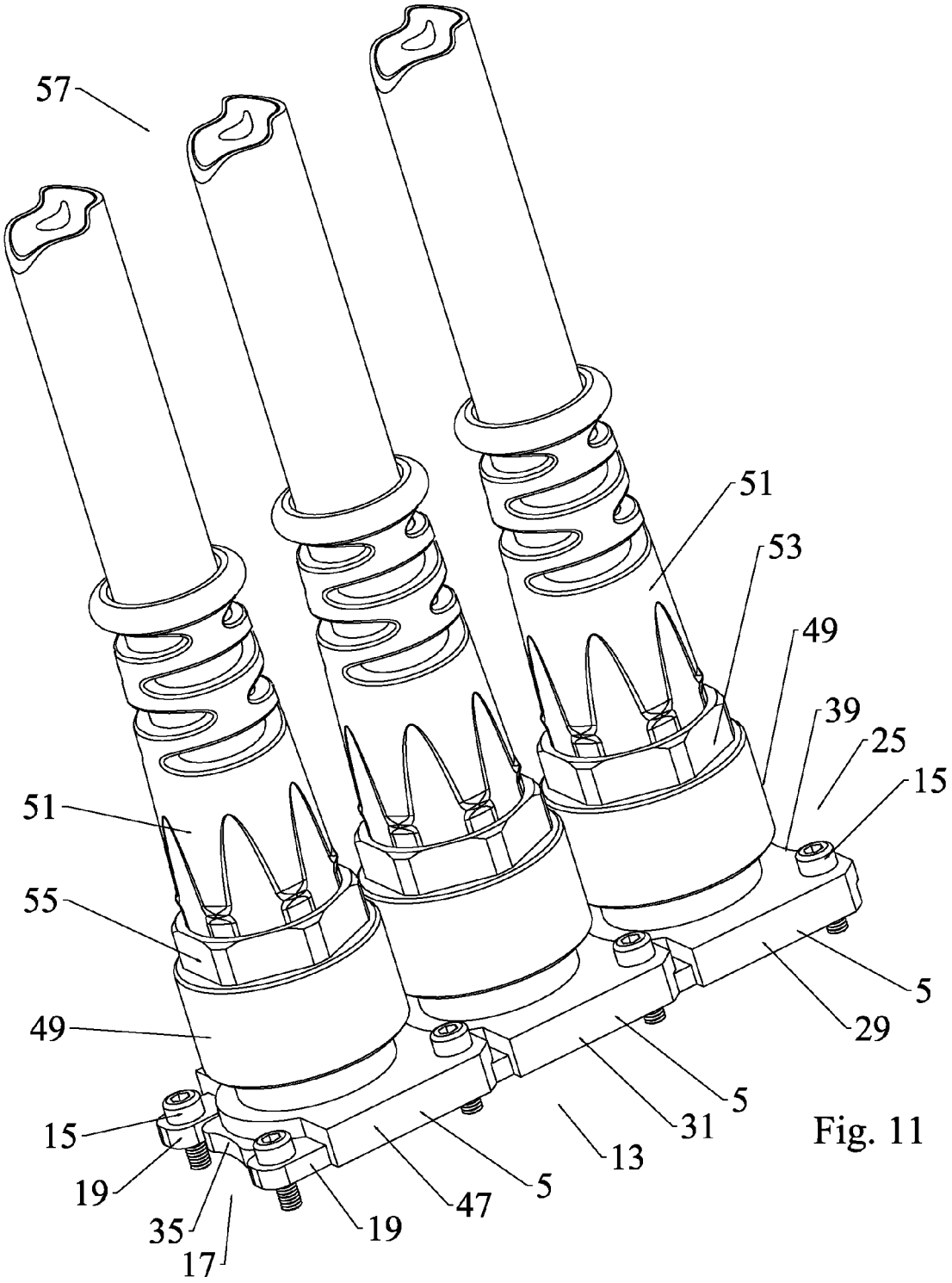
FIG. 11 is a schematic angled isometric view of FIG. 10, demonstrated with attaching connectors attached.
Figure 12:
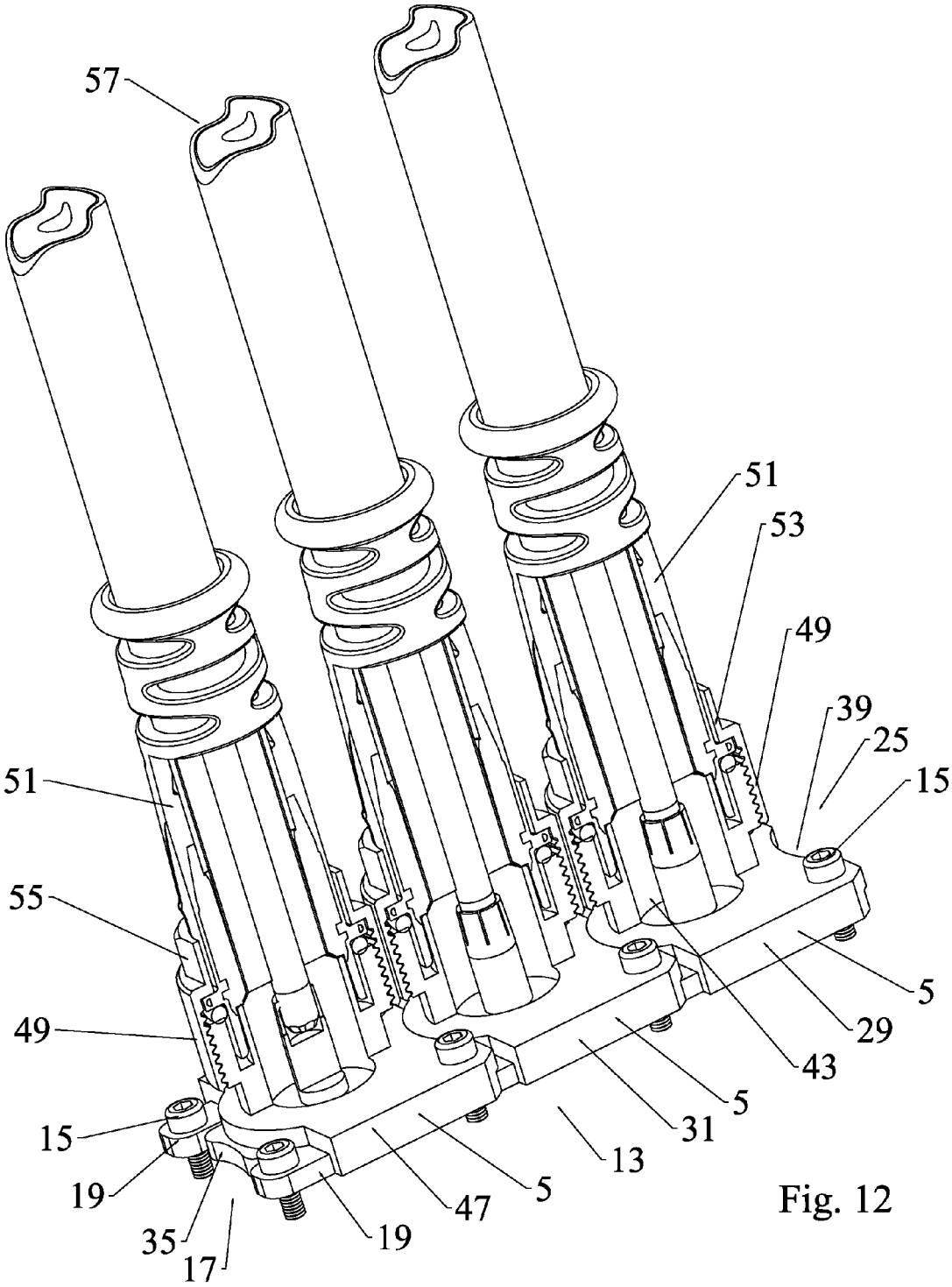
FIG. 12 is a partial cut-away view of FIG. 11.

The close proximity of the side by side connector bodies 3 may be limited by spacing between the selected connection interfaces 7 sufficient to enable rotation of a coupling nut 49 or the like to engage/disengage the interconnection with the connection interface 7. As shown in FIGS. 5 and 11, this spacing requirement may be minimized by adapting the coupling nut 49 of the corresponding attaching connector 51 to have engagement surfaces 53 such as tool faces 55 positioned at the cable end 57 of the coupling nut 49, recessed from a maximum outer diameter of the coupling nut 49.

Figure 13:
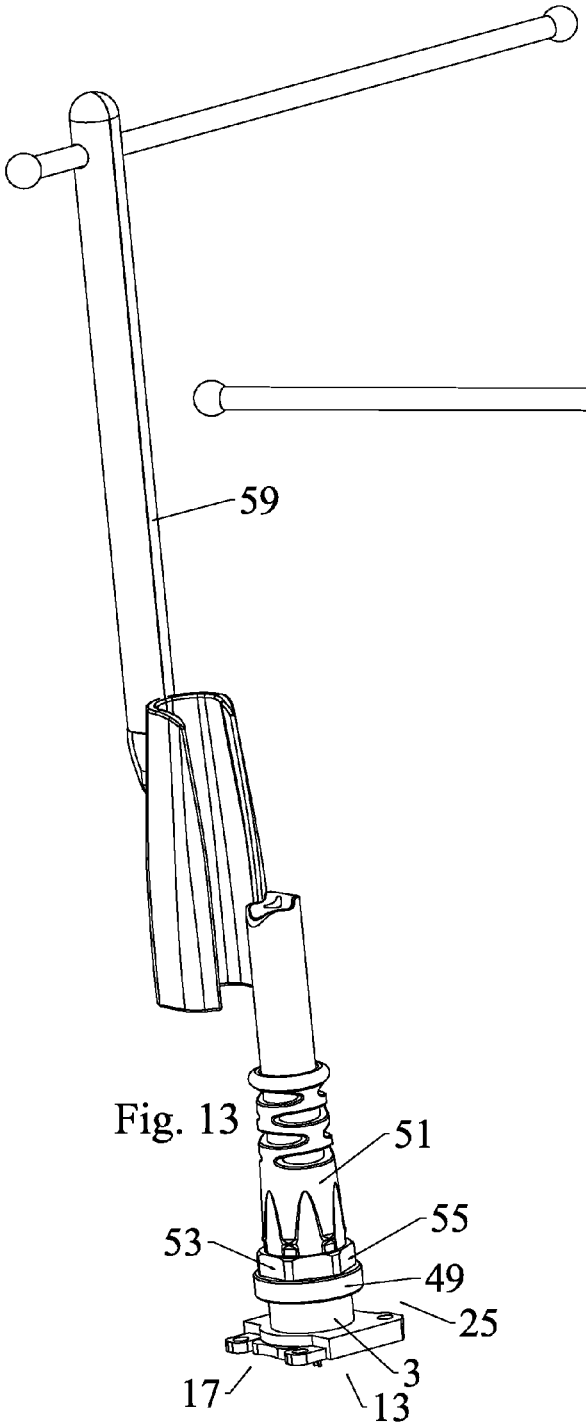
FIG. 13 is a schematic angled isometric view of a connector body with attached connector, with a basin wrench.
Figure 14:
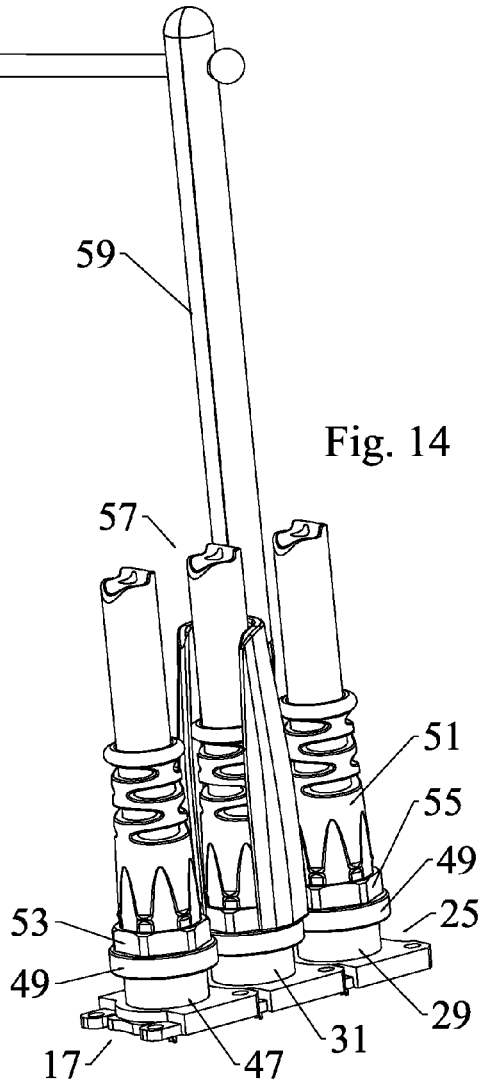
FIG. 14 is a schematic angled isometric view of a plurality of connector bodies coupled in close proximity, with attached connectors, demonstrating a basin wrench seated on the coupling nut of the attached connector of the second connector body, for rotation of the coupling nut.

Because of the close proximity, rotation of the coupling nut 49 with a conventional wrench coupling to the coupling nut 49 radially to the longitudinal axis of the attaching connector 51 allows only a short range of short angular rotation before the wrench must be repositioned to avoid interference from the adjacent attaching connectors 51. To enable access with reduced interference, a basin wrench 59 or the like, with a longitudinal dimension extended in a longitudinal axis of the connector direction, for example as shown in FIGS. 13 and 14, may be applied.

In addition to the reduced connector mounting space advantages, one skilled in the art will recognize that the sharing of the connector body mounting with adjacent interlocked connector bodies provides lateral mounting reinforcement and eliminates one half of the fasteners for each additional connector body 3, which may result in significant materials and/or labor efficiencies.

Table of Parts

| | |
|---|---|
| 3 | connector body |
| 5 | mounting flange |
| 7 | connection interface |
| 9 | interface end |
| 11 | planar surface |
| 13 | mounting end |
| 15 | fastener |
| 17 | male side |
| 19 | fastener tab |
| 21 | tab fastener hole |
| 23 | fastener slot |
| 25 | female side |
| 27 | slot fastener hole |

-continued

| Table of Parts | |
|---|---|
| 29 | first connector body |
| 31 | second connector body |
| 35 | flange tab |
| 37 | flange slot |
| 39 | female surface |
| 41 | male surface |
| 43 | bore |
| 45 | seal groove |
| 47 | additional connector body |
| 49 | coupling nut |
| 51 | attaching connector |
| 53 | engagement surface |
| 55 | tool face |
| 57 | cable end |
| 59 | basin wrench |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. Close proximity panel mount connectors, comprising:

a first and a second connector body, each of the first and the second connector bodies provided with:

a connection interface at an interface end;

a mounting flange with a planar surface at a mounting end;

a fastener tab of the mounting flange provided with a tab fastener hole at a male side of the connector body; and a fastener slot of the mounting flange formed at a female side of the connector body, a slot fastener hole provided through the mounting flange to the fastener slot;

the fastener tab of the first connector body seating within the fastener slot of the second connector body when the male side of the first connector body is seated adjacent to the female side of the second connector body, coaxially aligning the tab fastener hole of the first connector body and the slot fastener hole of the second connector body.

2. The connectors of claim 1, wherein each of the first and the second connector bodies has two fastener tabs and two fastener slots.

3. The connectors of claim 2, wherein each of the tab fastener holes and each of the slot fastener holes is provided proximate a corner of the mounting flange.

4. The connectors of claim 2, wherein a perimeter line between each of the tab fastener holes and each of the slot fastener holes is a rectangle in a plane of the planar surface.

5. The connector of claim 2, further including a flange tab on the male side, between the two fastener tabs and a flange slot on the female side, between the two fastener slots; the flange tab also seating within the flange slot when the male side of the first connector body is seated adjacent to the female side of the second connector body.

6. The connector of claim 1, wherein the planar surface surrounds the fastener slot on three or more sides.

7. The connector of claim 1, further including a bore through the connector body between the interface end and the mounting end.

8. The connector of claim 7, further including a seal groove in the planar surface surrounding the bore; the seal groove open to the mounting end.

9. The connector of claim 1, wherein the female side of the mounting flange has a female surface provided as a convex surface and the male side of the mounting flange has male surface formed as a concave surface; the convex surface and the concave surface provided with a common radius of curvature.

10. A method for mounting close proximity panel mount connectors on a mounting surface, comprising the steps of:

providing a first and a second connector body, each of the first and the second connector bodies provided with:

a connection interface at an interface end;

a mounting flange with a planar surface at a mounting end;

a fastener tab of the mounting flange provided with a tab fastener hole at a male side of the connector body; and a fastener slot of the mounting flange formed at a female side of the connector body, a slot fastener hole provided through the mounting flange to the fastener slot;

seating the fastener tab of the first connector body within the fastener slot of the second connector body as the female side of the second connector body is seated adjacent to the male side of the first connector body, coaxially aligning the tab fastener hole of the first connector body and the slot fastener hole of the second connector body.

11. The method of claim 10, further including the step of inserting a fastener through each of the tab fastener hole, the slot fastener hole and the mounting surface.

12. The method of claim 10, further including the step of coupling an attaching connector to the connection interface of the first connector body.

13. The method of claim 12, wherein the coupling is via insertion of the attaching connector into a bore of the first connector body and rotation of a coupling nut engaging the connection interface until the attaching connector is retained against the connection interface.

14. The method of claim 13, wherein the rotation of the coupling nut is via a wrench with a shaft which extends in a longitudinal axis of the attaching connector.

15. The method of claim 13, wherein the coupling nut has tool flats on a cable end of the coupling nut.

16. The method of claim 15, wherein the tool flats are recessed from a maximum outer diameter of the coupling nut.

17. The method of claim 10, further including the step of mounting an additional connector body adjacent to the second connector body, the additional connector body provided with:

a connection interface at an interface end;

a mounting flange with a planar surface at a mounting end;

a fastener tab of the mounting flange provided with a tab fastener hole at a male side of the connector body; and a fastener slot of the mounting flange formed at a female side of the connector body, a slot fastener hole provided through the mounting flange to the fastener slot;

seating the female side of the additional connector body adjacent to the male side of the additional connector body, coaxially aligning the tab fastener hole of the second connector body and the slot fastener hole of the additional connector body.

* * * * *